US006390574B2

(12) United States Patent
Fraccaro

(10) Patent No.: US 6,390,574 B2
(45) Date of Patent: May 21, 2002

(54) FULLY EXTENDIBLE DRAWER UNIT AND COUPLING

(75) Inventor: Georg Fraccaro, Dafins (AT)

(73) Assignee: Grass GmbH, Kernersville, NC (US)

( * ) Notice: Subject to any disclaimer, the term of this patent is extended or adjusted under 35 U.S.C. 154(b) by 0 days.

(21) Appl. No.: 09/732,501

(22) Filed: Dec. 7, 2000

(30) Foreign Application Priority Data

| | | |
|---|---|---|
| Dec. 13, 1999 | (CH) | 2284/99 |
| Jan. 28, 2000 | (CH) | 180/00 |
| Mar. 6, 2000 | (CH) | 433/00 |

(51) Int. Cl.[7] ..... A47B 88/00
(52) U.S. Cl. ..... 312/333; 312/334.12
(58) Field of Search ..... 312/333, 334.44, 312/334.47, 334.45, 334.12, 334.7, 334.8, 334.18; 384/19, 21

(56) References Cited

U.S. PATENT DOCUMENTS 4,181,383 A * 1/1980 Naef ..... 312/334.12

FOREIGN PATENT DOCUMENTS

| | | | |
|---|---|---|---|
| AT | 392 401 | B | 3/1991 |
| CH | 677 593 | A5 | 6/1991 |
| DE | 674548 | | 4/1939 |
| DE | 20 18 671 | | 10/1971 |
| DE | 39 42 974 | A1 | 6/1991 |
| DE | 41 21 070 | C2 | 1/1993 |
| DE | 296 21 957 | U1 | 3/1997 |
| EP | 19163 | * | 11/1980 |

* cited by examiner

*Primary Examiner*—Janet M. Wilkens
(74) *Attorney, Agent, or Firm*—John M. Harrington; Kilpatrick Stockton LLP

(57) ABSTRACT

A fully extendible drawer unit utilizes two pairs of, in each case, three rails which can be pushed into one another. On the carcass rail is positioned a differential roller, which allows the intermediate rail to be moved along when the drawer starts to be pulled out at a lower speed than the drawer and the drawer rail. A coupling lever ensures that the intermediate rail is still pushed along even when the drawer rail has already left the differential roller and that this happens synchronously.

13 Claims, 18 Drawing Sheets

FULLY EXTENDIBLE DRAWER UNIT AND COUPLING

FIELD OF THE INVENTION

The present invention relates generally to the field of drawer units and more particularly to fully extendible drawer units and couplings therefor.

BACKGROUND OF THE INVENTION

Fully extendible chests of drawers, abbreviated extendible chests of drawers, are known in many embodiments and, if there is to be full extension with over-extension, i.e. the drawer can be pulled completely out of the carcass, they have respectively three rails, namely a carcass rail, a drawer rail and in between an intermediate rail relatively movable with respect to both rails. In the simplest configuration the three rails are mutually connected to one another via rollers and the intermediate rail is pulled along when the drawer is pulled out. To ensure that the intermediate rail is pulled out evenly, various measures are known by which said intermediate rail is carried along, while the speed at which it is pulled out is reduced in respect of the drawer.

From German patent specification 674548 a guide device for a chest of drawers is known, in which the intermediate rails run on rollers comprising two steps with different diameter. By choosing an unequal diameter ratio of 2:1, for example 8:4, it is achieved that the intermediate rail remains slightly behind and when the drawer is fully pulled out there is good, even support.

To enable even carrying of the two intermediate rails it is proposed in CH-AS 677593 to provide the roller on the intermediate rail with a set of teeth designated to engage in a tooth rod on the carcass rail.

DE-A1 41 21 070 proposes, instead of a set of teeth, connecting the rails by means of a belt which runs via a differential roller and thus allows the speed gradient of the three rails relative to one another to be pre-set.

Because the intermediate rails are pulled out substantially evenly with the drawer, all these known embodiments enable good, even, smooth support of the latter. They are, however, characterized by a complicated construction and are consequently expensive to produce.

SUMMARY OF THE INVENTION

An object of the present invention is to create a fully extendible drawer unit which has a simple, cheaply produced construction and allows the drawer to be pulled out and pushed in gentle, without jolting and with ease of movement. A further object of the invention is to create a coupling which enables defined carrying of the intermediate rail.

Additional objects, advantages and novel features of the invention will be set forth in part in the description which follows, and in part will become more apparent to those skilled in the art upon examination of the following, or may be learned from practice of the invention.

Mounting the differential roller on the front edge of the carcass rail effects constantly non-positive carrying of the intermediate rail right from the start of the pulling out movement of the drawer from the carcass. Once the rear end of the drawer, and therefore of the drawer rail, has passed the differential roller, a coupling on the intermediate rail acts on a carrier on the drawer rail and effects that the two intermediate rails synchronously with the drawer are carried further outwards, thereby guaranteeing constant, problem-free, even support and quiet running of the drawer.

BRIEF DESCRIPTION OF THE DRAWINGS

The Invention is explained in more detail with the aid of an illustrated embodiment.

FIG. 16 shows an enlarged representation of a cross-section, with the lever before latching in.

FIG. 17 shows an enlarged representation of a cross-section with the lever after latching in.

DETAILED DESCRIPTION

Figure 1:
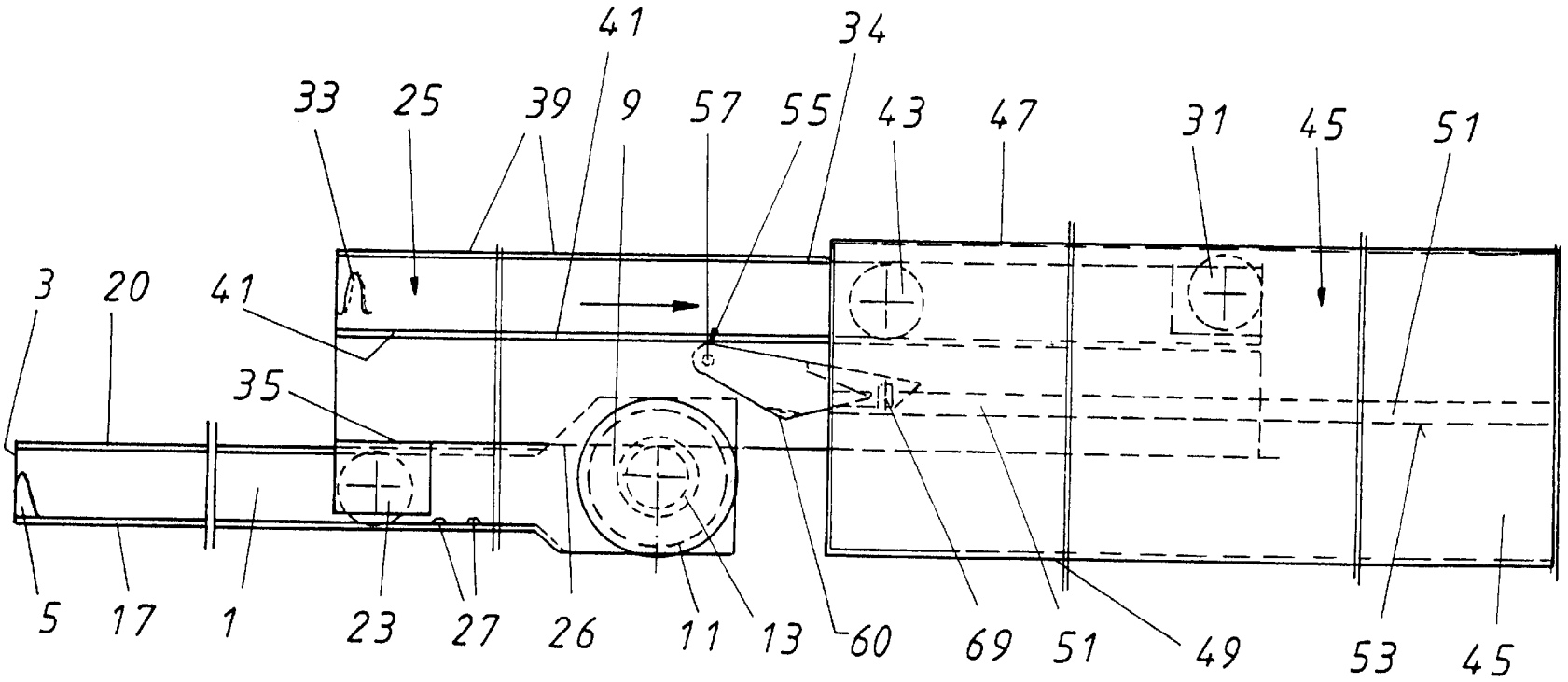
FIG. 1 shows a side view of the carcass, intermediate and drawer rails inside one another.
Figure 2:
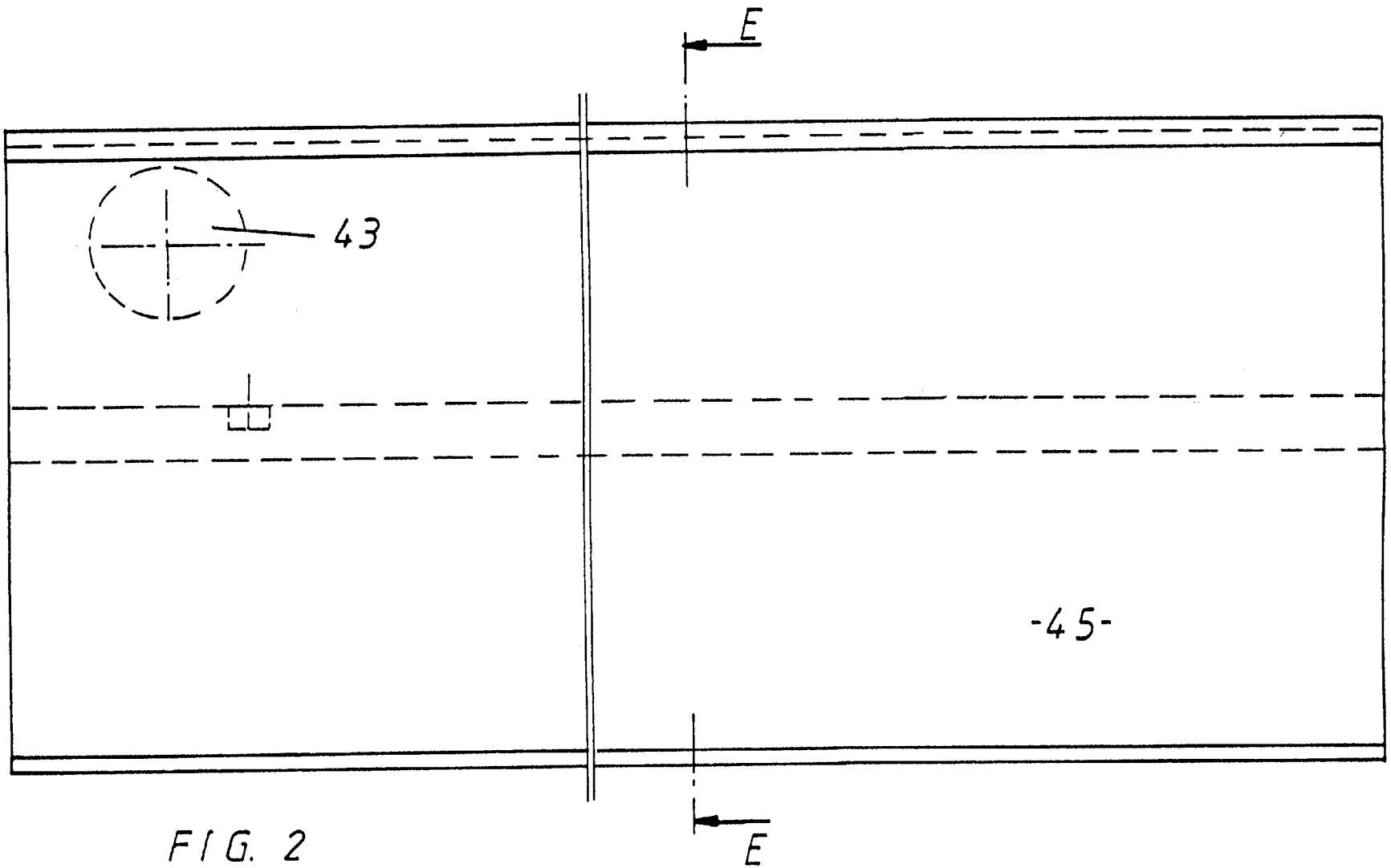
FIG. 2 shows a side view of the rear end of the drawer rail.
Figure 3:
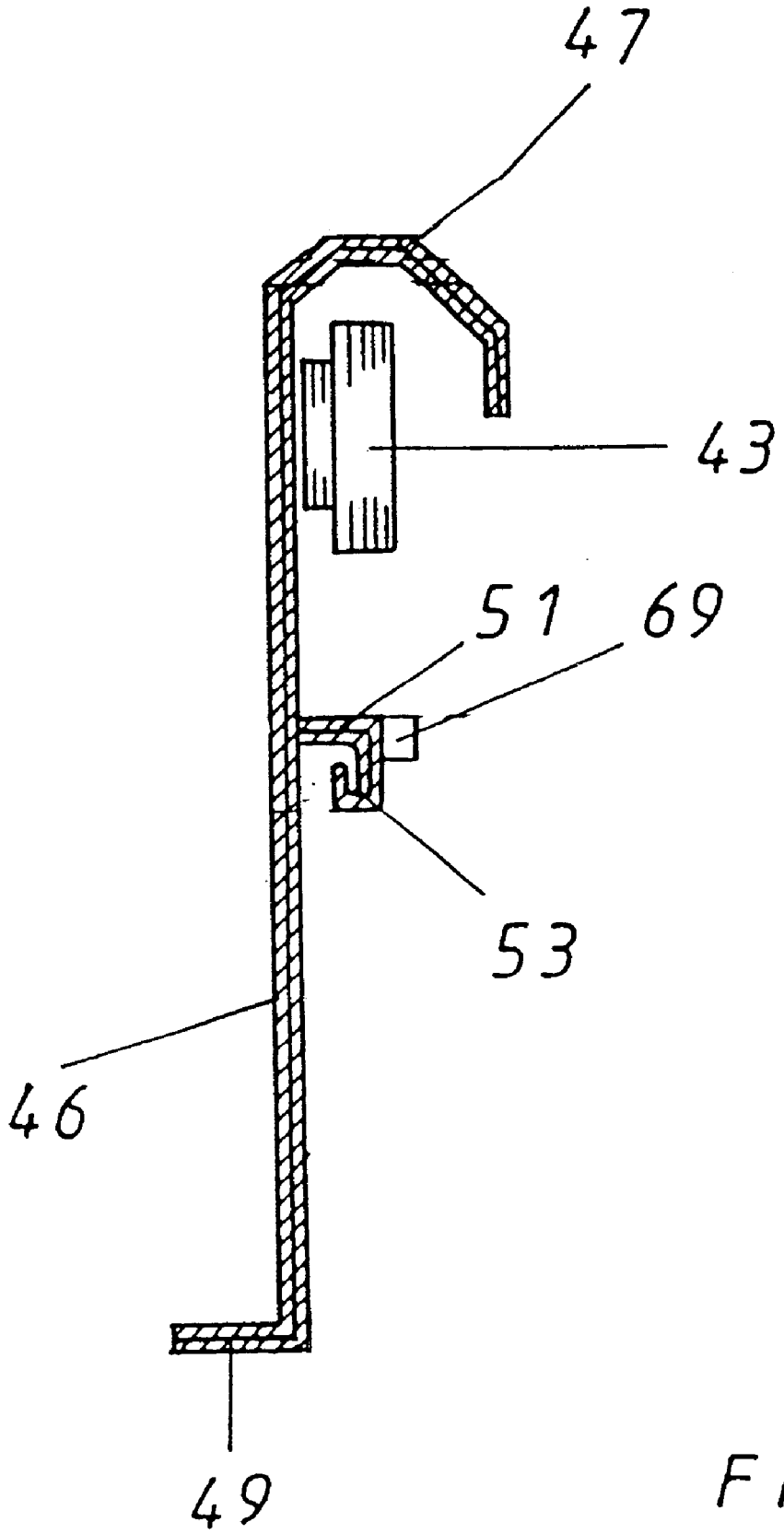
FIG. 3 shows a cross-section through the drawer rail along line E—E in FIG. 2.
Figure 4:
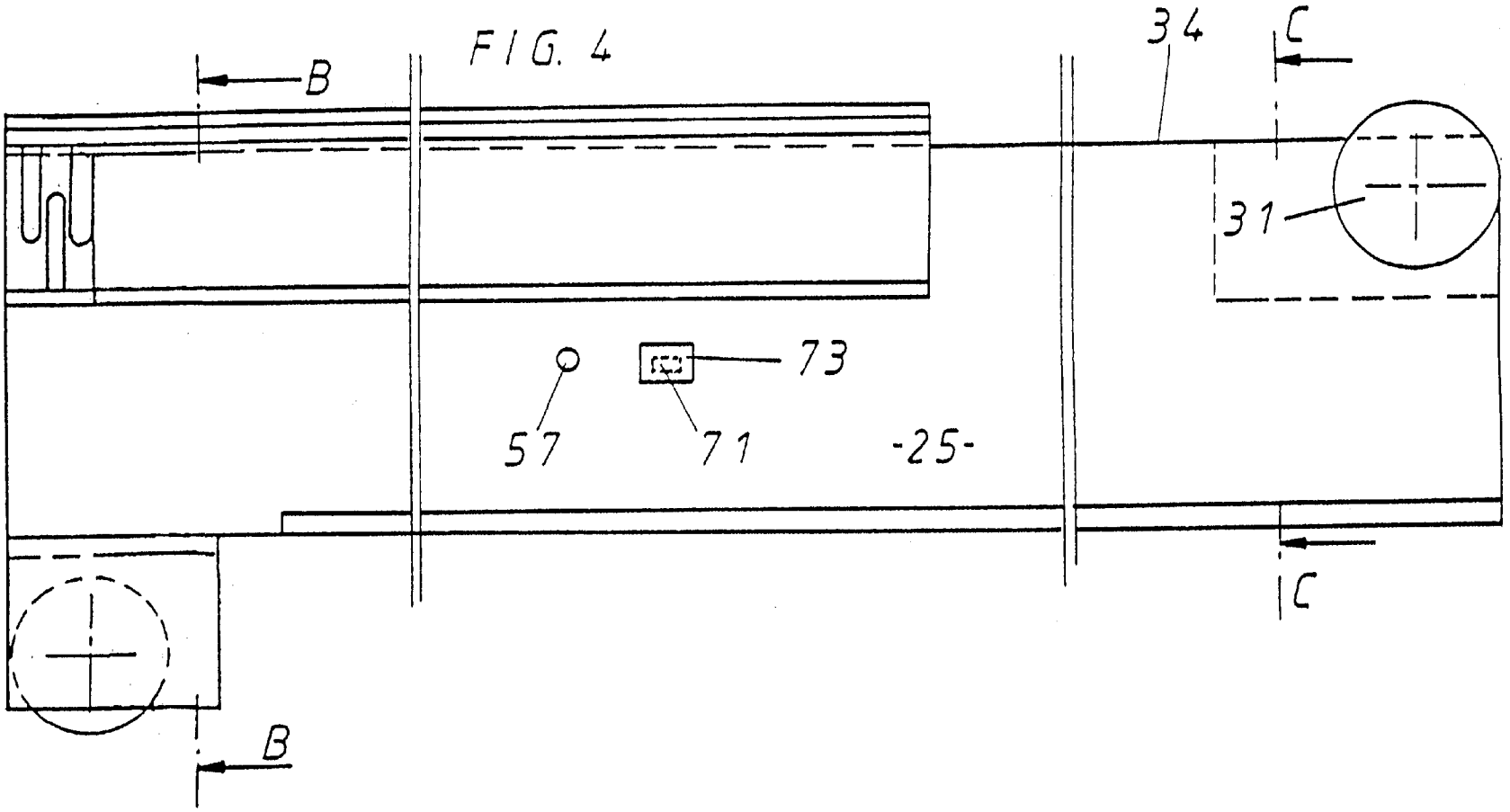
FIG. 4 shows a side view of the intermediate rail.
Figure 7:
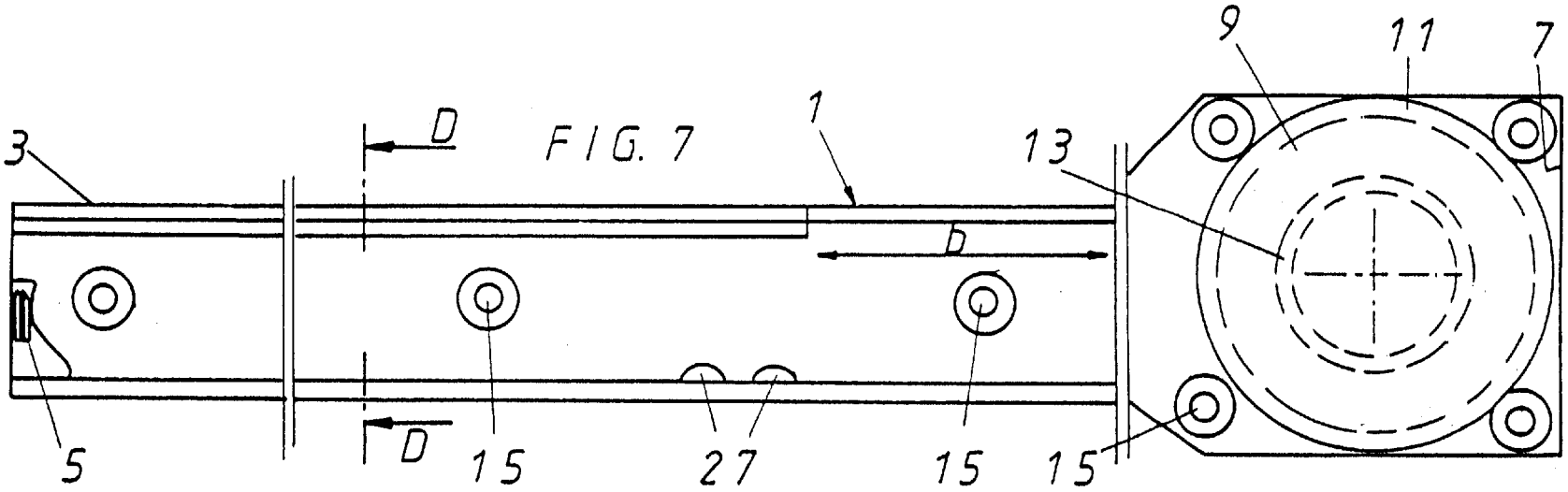
FIG. 7 shows a side view of the carcass rail.
Figure 8:
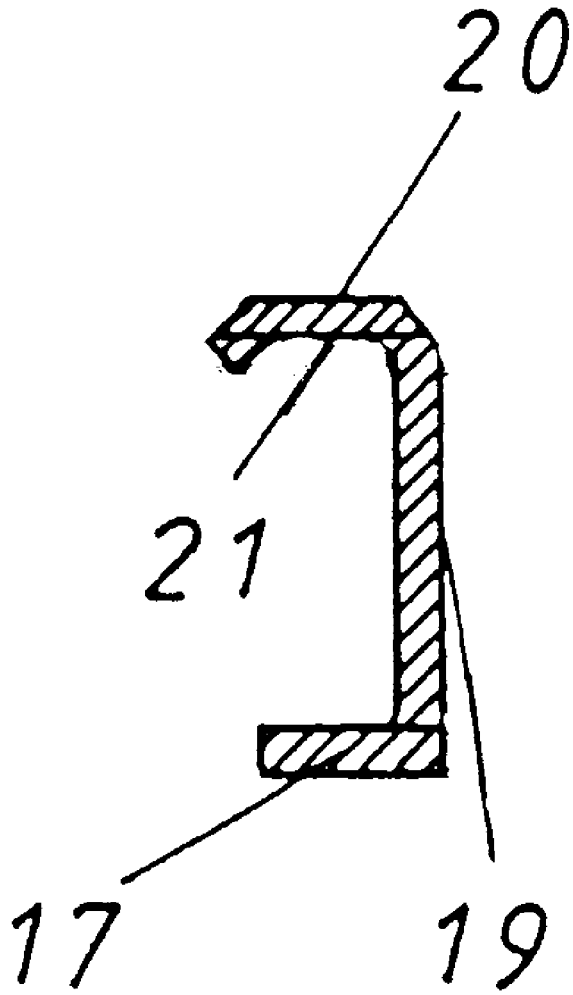
FIG. 8 shows a cross-section through the carcass rail along the line D—D in FIG. 7
Figure 9:
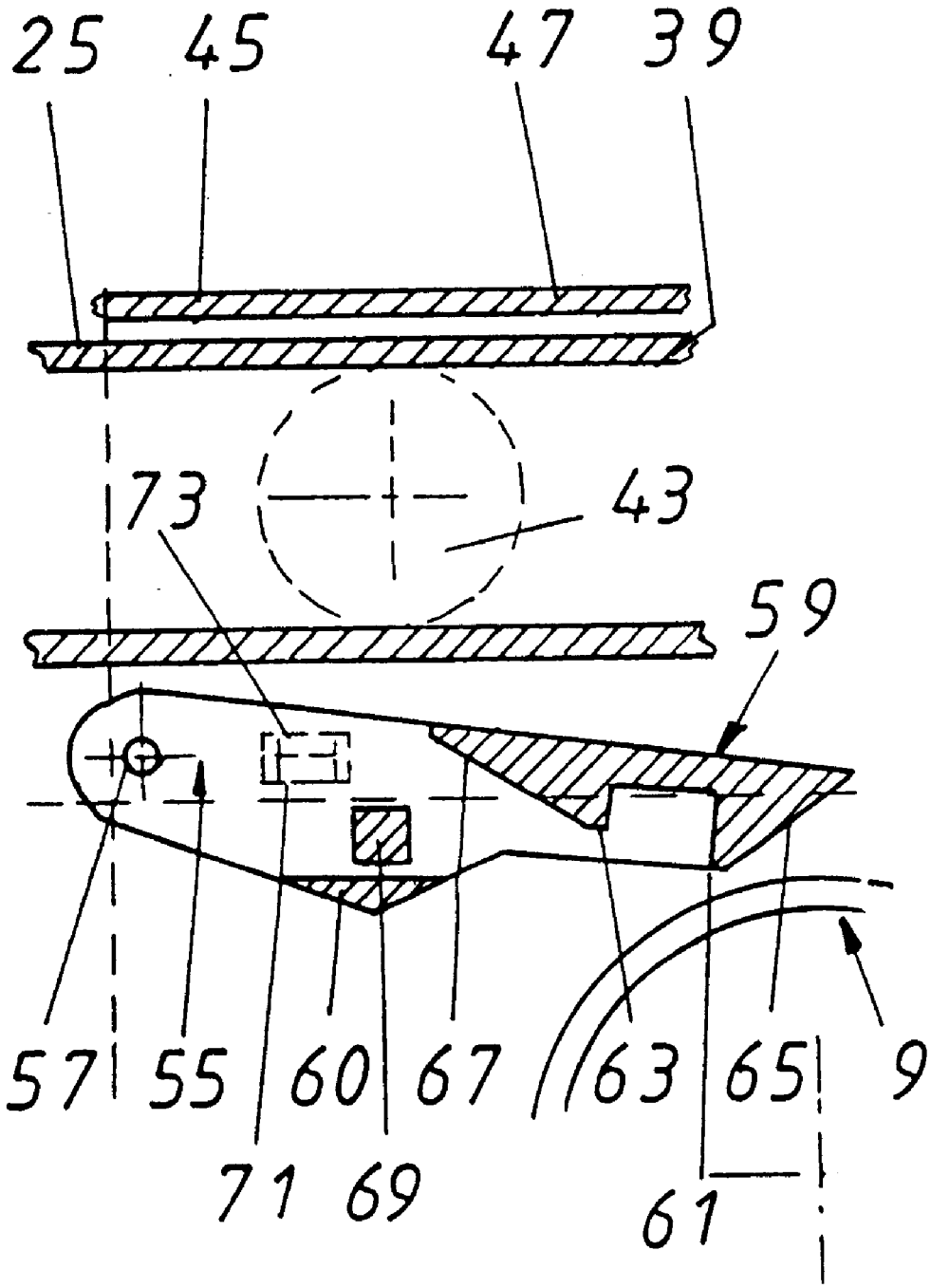
FIG. 9 shows a side, view of the rear end of the drawer rail and the intermediate rail placed therein and also the differential roller under the intermediate rail.

Reference numeral 1 in FIGS. 1 and 7 represents a carcass rail 1, on whose rear end 3 a buffer stop 5 and on whose front end 7 a two-step differential roller 9 are rotatably positioned. In the region of the differential roller 9 the upper edge of the carcass rail 1 runs tangentially to the apex of the differential roller 9. The differential roller 9 comprises a groove 11 with the larger diameter and a groove 13 with the smaller diameter. As an example, seven holes 15 serve to guide through screws to attach the carcass rail 1 to a carcass inner wall (not illustrated). The lower leg 17 of the carcass rail 1 in the example illustrated runs level and at a right angle to the base leg 19. The upper leg 20 forms a downwardly concave groove 21. The concave groove 21 ends at a distance in front of the end 7 (FIG. 7). The distance enables the rear roller 23 on the intermediate rail 25 to be inserted from above into the space between the lower leg 17 and the upper leg 20 of the carcass rail 1. Preferably two pull-stops 27 are moulded onto the lower leg 17, for example in the form of bosses forming a temporary buffer for the rear roller 23 of the intermediate rail 25. The rear roller 23 on the intermediate rail 25 protrudes beyond the lower leg 17 thereof.

Figure 5:
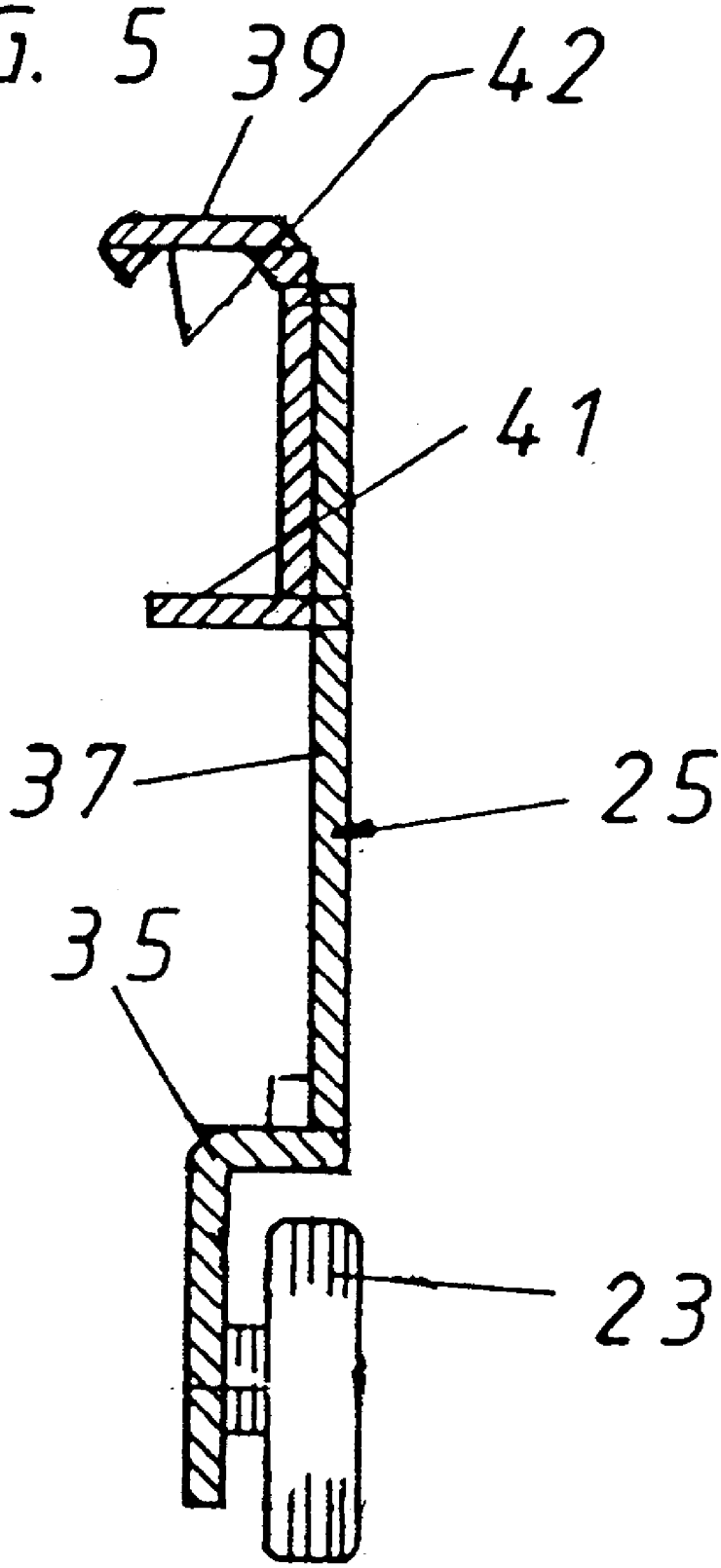
FIG. 5 shows a cross-section through the intermediate rail along line B—B in FIG. 4.
Figure 6:
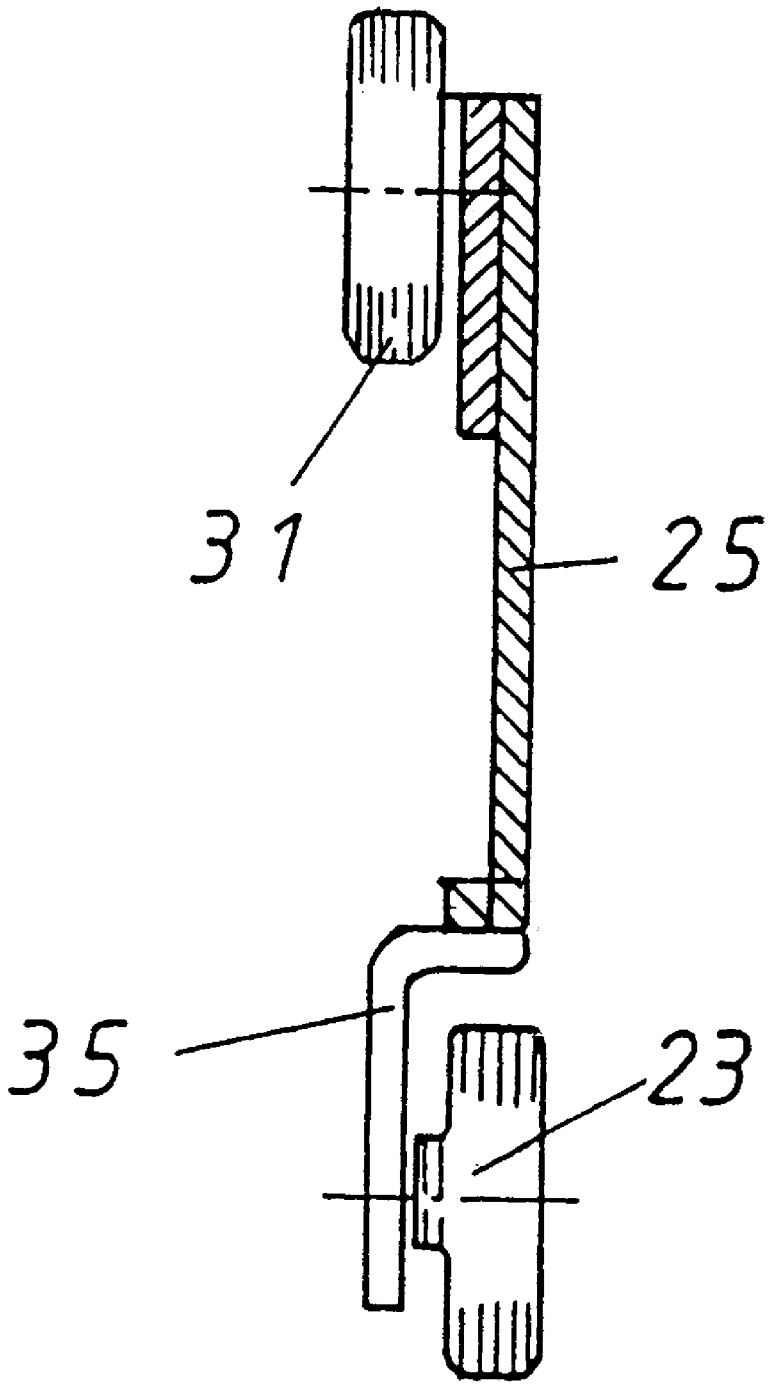
FIG. 6 shows a cross-section through the intermediate rail along line C—C in FIG. 4.
Figure 11:
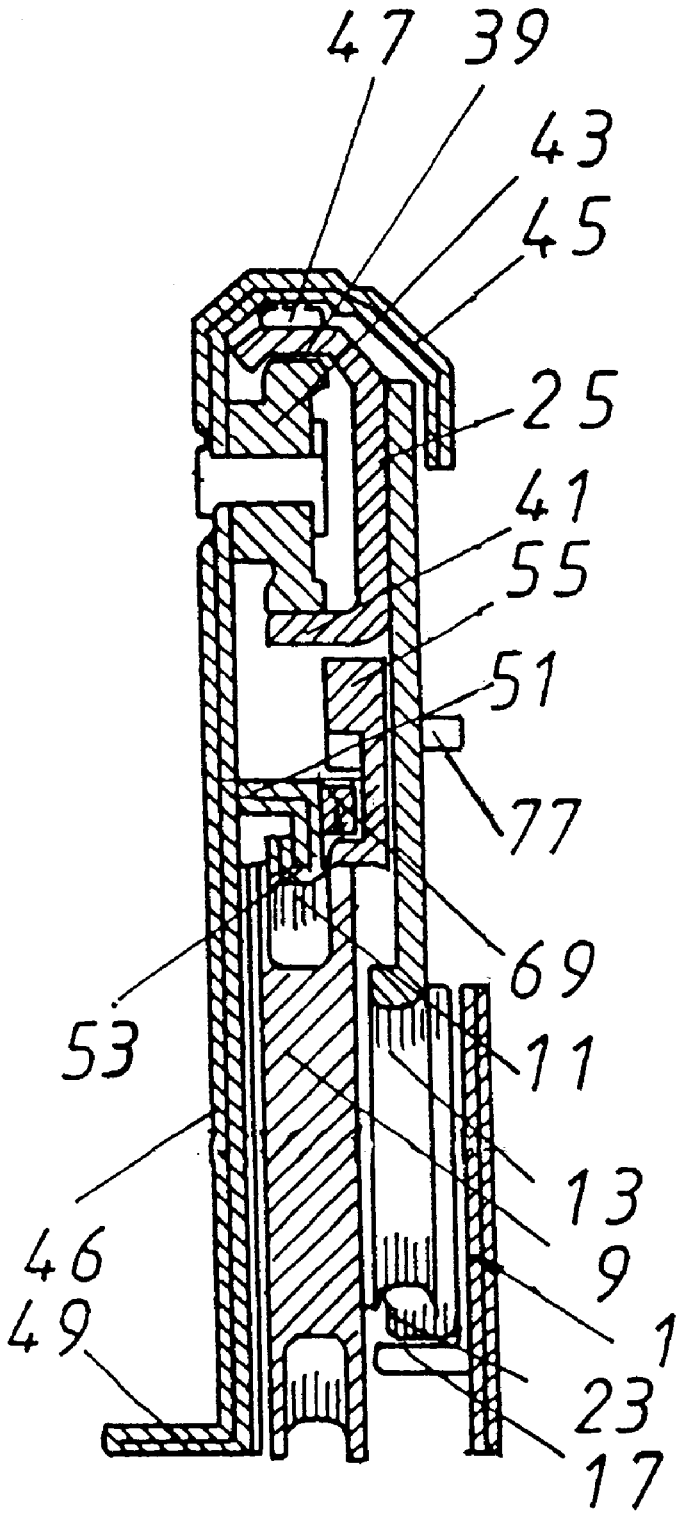
FIG. 11 shows a cross-section along line A—A in FIG. 10 through the three rails.

The intermediate rail 25 further comprises a front roller 31 which protrudes beyond the upper edge 34 of the intermediate rail 25. A buffer stop 33 can also be constructed at the rear of the intermediate rail 25. In the cross-sections according to FIGS. 5 and 6 of the intermediate rail 25 it can be seen that rear roller 23 located at the bottom is preferably rotatably attached in an off-set region 35 of the base leg 37 of the intermediate rail 25. This enables the roller 23 to come to rest in the plane of the base leg 37, thereby making it possible for the structure to be narrow. On the upper edge of the base leg 37 a c-shaped rail 39 with a lower flat running face 41 and a concave upper guide device 42 is constructed or attached. The c-shaped rail 39 extends only over the rear half of the intermediate rail 25. The latter serves to guide the single roller 43 in the region of the rear edge of the drawer rail 45. This comprises a plate 46, designated to adjoin the drawer, on whose lower edge a leg 49 is constructed, on which the floor of the drawer (not illustrated) comes to rest and can be attached. On the upper edge of the drawer rail 45 a guide track 47 is mounted, which forms a guide and running face for the front roller 31 on the intermediate rail 25. In the central region of the plate 46 of the drawer rail 45 a carrying rail 51 with a running face 53 directed downwards is attached. The latter comes into contact with the groove on the large diameter 11 of the differential roller 9 when the drawer is partially pushed into the carcass (compare situation in FIG. 11).

A one-armed lever 55 is further pivotably coupled to a pin 57. The lever 55, which acts as a coupling, comprises a hook-shaped end 69, formed from an outer lug 61 and an inner lug 63. A leading or sliding face 65 and the flank 67 adjoin the lugs 61 and 63. The sliding face 65 is located between the end of the lever 55 and the lug 61; the flank 67, which is inclined at an obtuse angle to the sliding face 65, extends in the direction of the pin 57. The sliding face 65 and the flank 67 are located in a region protruding laterally beyond the surface of the lever 55.

On the lower edge of the lever 55 is further constructed a curve running at an obtuse angle, whose function will be explained in the functional description. Attached to the drawer rail 45, on the carrying rail 51, is a cam 69, into which the lever 35 can be latched. In the proximity of the pin 57 additionally attached to the lever 55 is a trigger 71, which penetrates a recess 73 in the intermediate rail 25.

The mode of operation of the fully extendible drawer unit is explained in more detail below. When the drawer is pulled out the differential roller 9 is set in motion by the carrying rail 51 attached to the drawer rail 45, the running face 53 of said carrying rail 51 being supported on the larger diameter 11 of the differential roller 9, thereby also setting in motion the intermediate rail 25, which rests on the smaller diameter 13 of the differential roller 9. The speed of movement of the intermediate rail 25 corresponds to the ratio of the two diameters on the differential roller 9. The intermediate rail 25 is supported while the drawer is being pulled out on the one hand from below by the differential roller 9 (there by the smaller diameter 13) on the lower edge 26 and prevented from tilting by the rear roller 23 attached to the intermediate rail 25, which runs inside the carcass rail 1. The roller 23 is herein supported in the concave groove 21 of the upper leg 20 and is also guided laterally by the groove 21. The drawer itself, which is attached to the two drawer rails 45, is supported on the pull-out side, i.e. at the front, on the front roller 31 of the intermediate rail 25. The roller 31 is herein guided in the guide track 47 of the drawer rail 45. To prevent the drawer from tipping the rear roller 43 of the drawer rail 45 is supported on the rail 39 of the intermediate rail 25.

Figure 10:
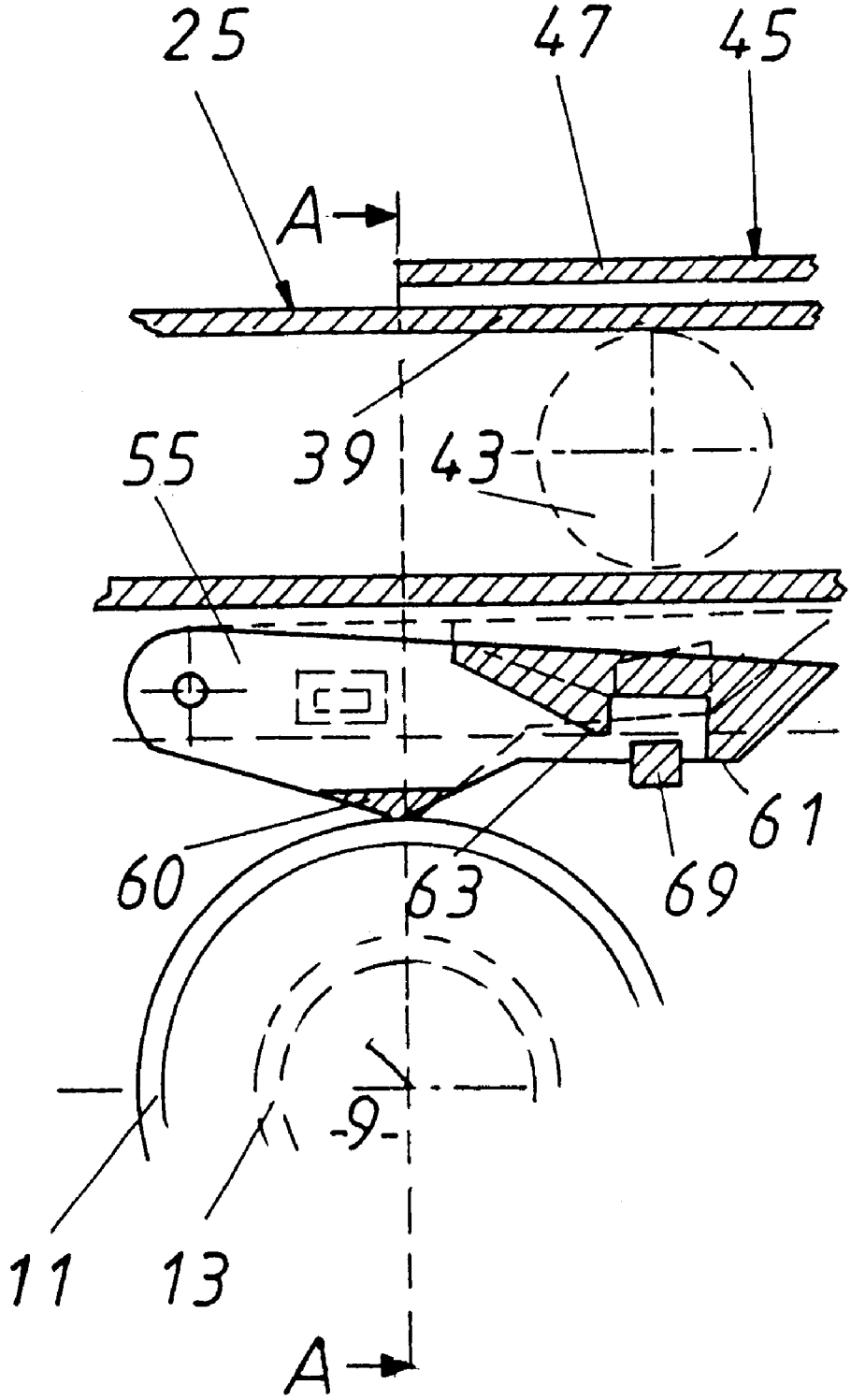
FIG. 10 shows a side view of the rear end of the drawer rail and the intermediate rail placed therein and the coupling lifted from the differential roller.
Figure 12:
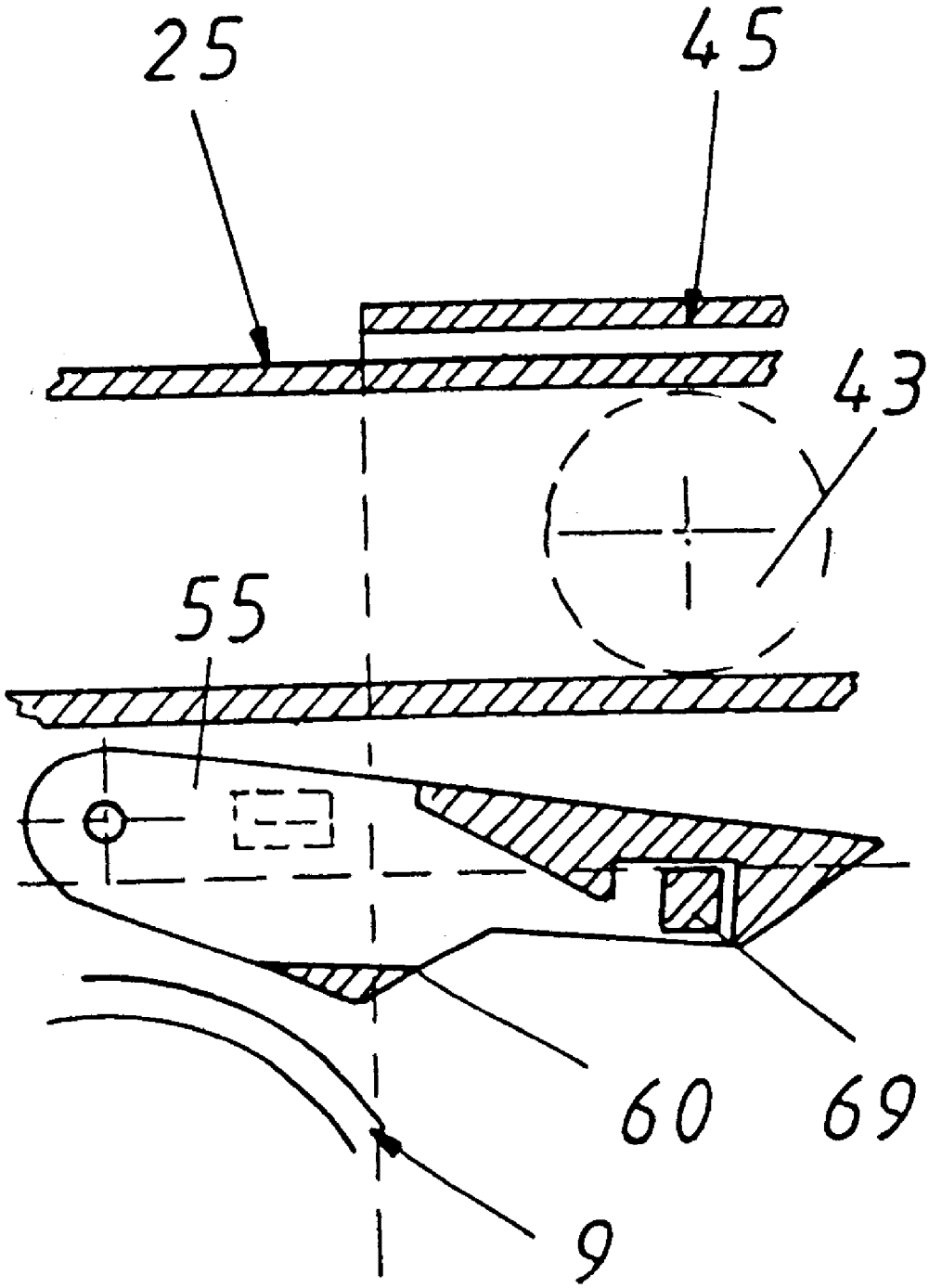
FIG. 12 shows a side view of the rear end of the drawer rail and the intermediate rail placed therein and also the differential roller on the carcass rail.
Figure 14:
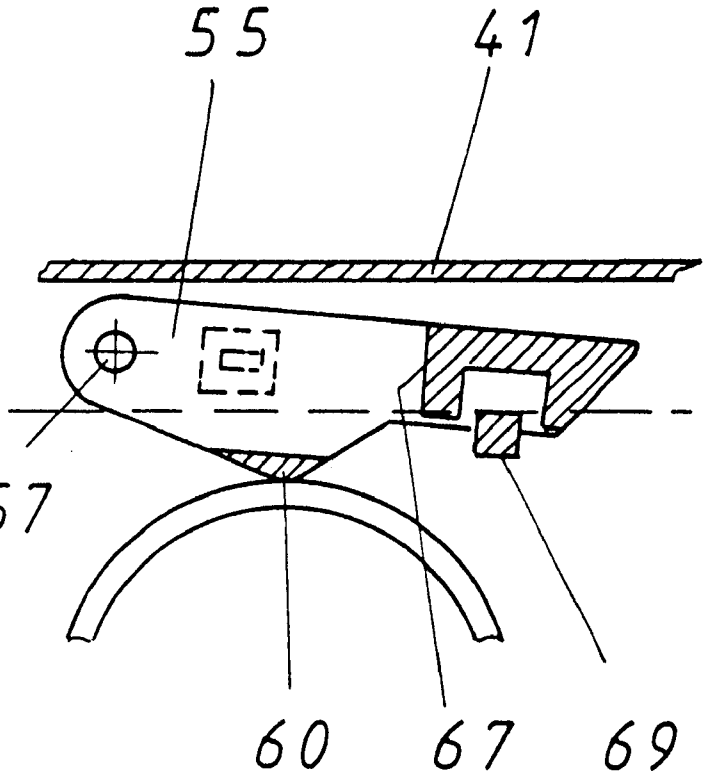
FIG. 14 shows a side view of the lever in FIG. 13 lifted by the differential roller.

The roller 31 on the intermediate rail 25 is preferably positioned in such a way that the guide track 47 does not rest on the roller 31 when the drawer is pushed in and the roller 31 does not take on a supporting function until the drawer is pulled out. In this manner it is guaranteed that initially, when the drawer is pulled out, the drawer rail 45 rests almost exclusively on the differential roller 9, thereby setting this in motion. To guarantee that the intermediate rail 25 is carried along even if the drawer rail 45 has already left the region of the differential roller 9, the lever 55 is provided. If in the process of pulling out the drawer, at the latest when the carrier 69 reaches the flank 67 of the coupling lever 55, the coupling lever 55 is lifted and the carrier 69 passes through under the lug 64 (FIG. 10) until it reaches the flank of the lug 61 and latches in. The intermediate rail 25 is now carried along synchronously to the end, i.e., until the drawer is fully or over pulled out (FIG. 12). The large lug 61 is located, with respect to the smaller lug 63, in front and downwards, so that—if the coupling lever 55 is lifted from the differential roller 9 by the curve 60—the carrier 69 cannot come unlatched.

Figure 13:
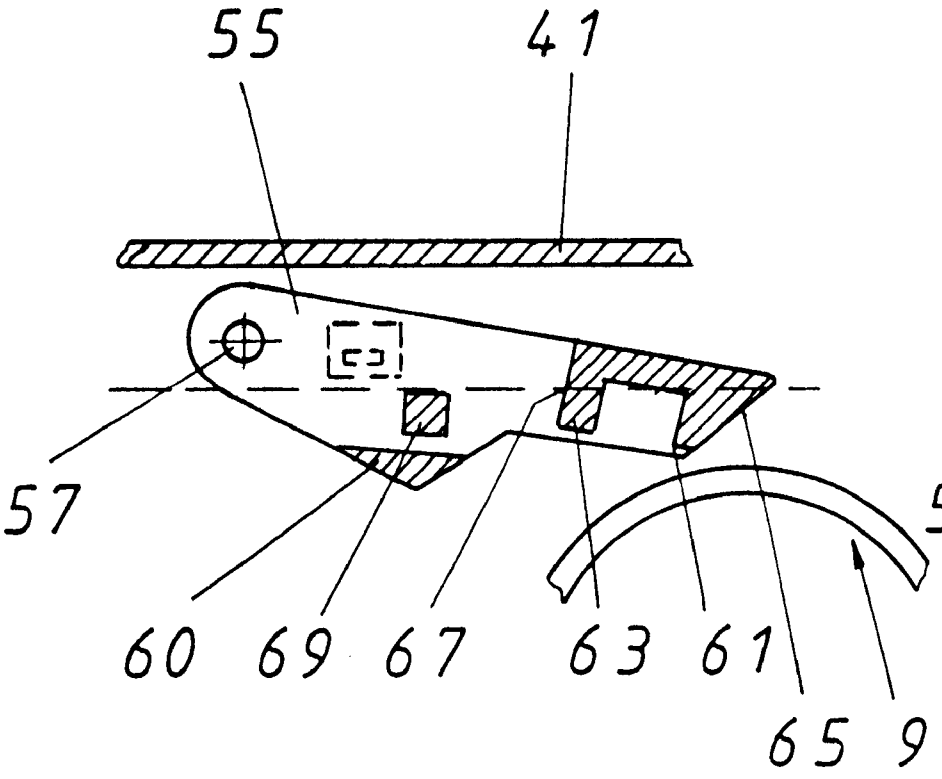
FIG. 13 shows a side view of the lever according to a further configuration of the invention before contact with the differential roller.
Figure 15:
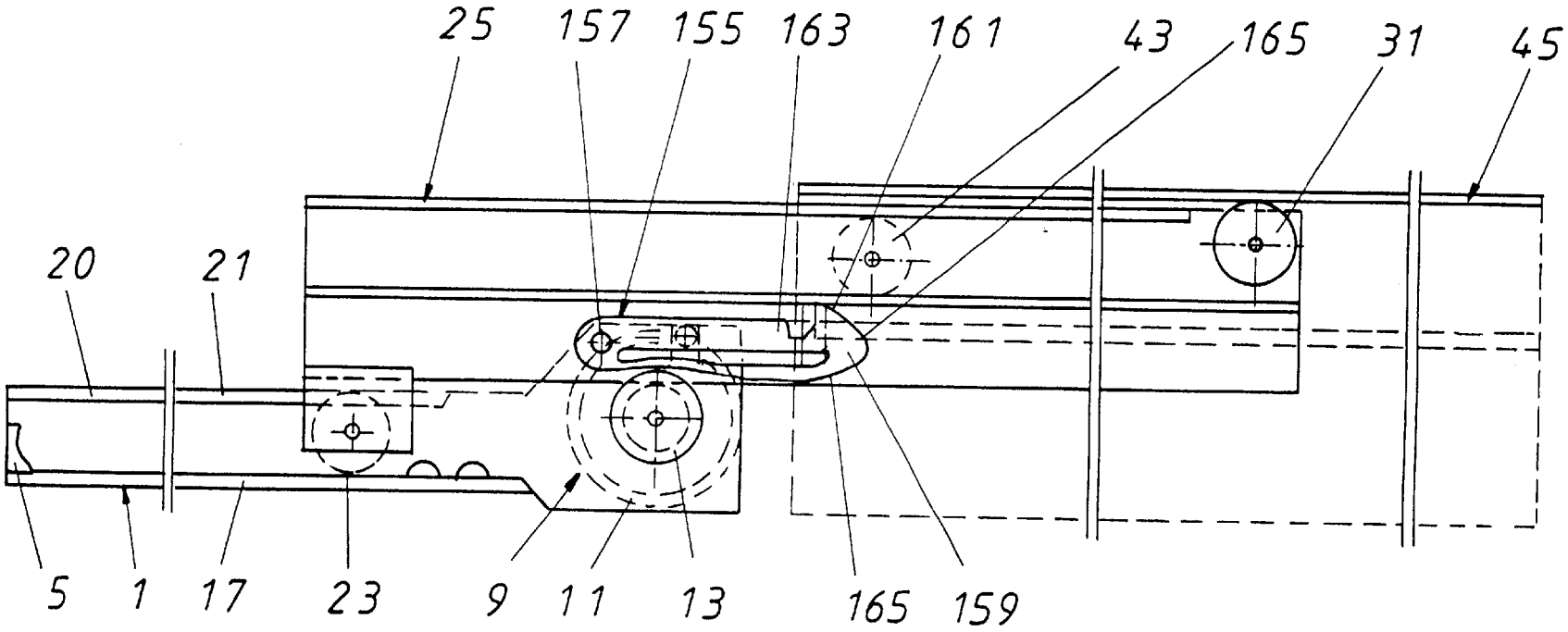
FIG. 15 shows a side view of the three rails with a coupling lever which can be latched in from below.
Figure 16:
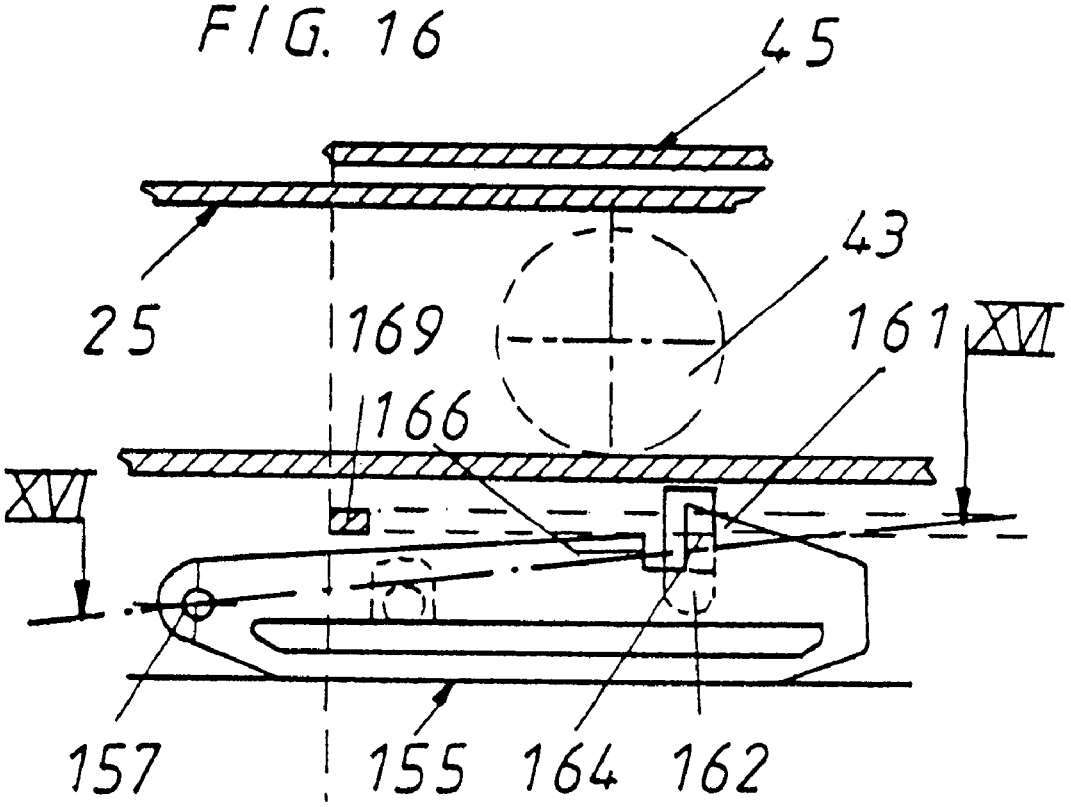
Figure 17:
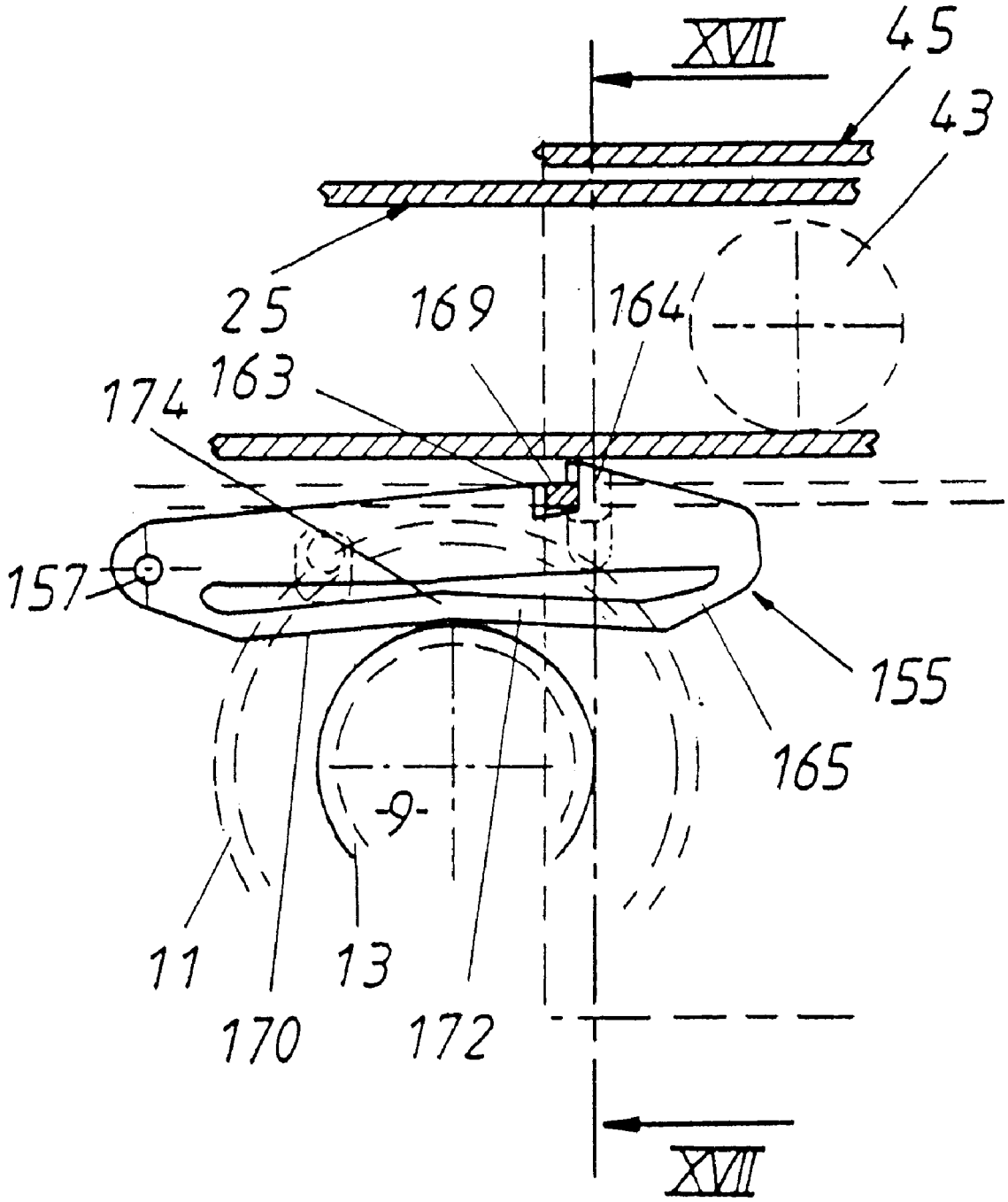
Figure 18:
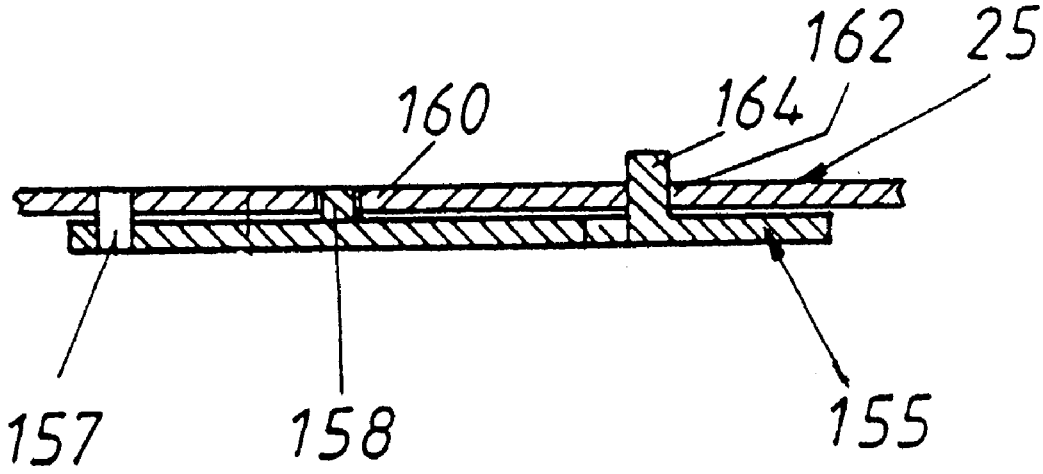
FIG. 18 shows a longitudinal section through the lever and the intermediate rail along line XVI—XVI in FIG. 16.
Figure 19:
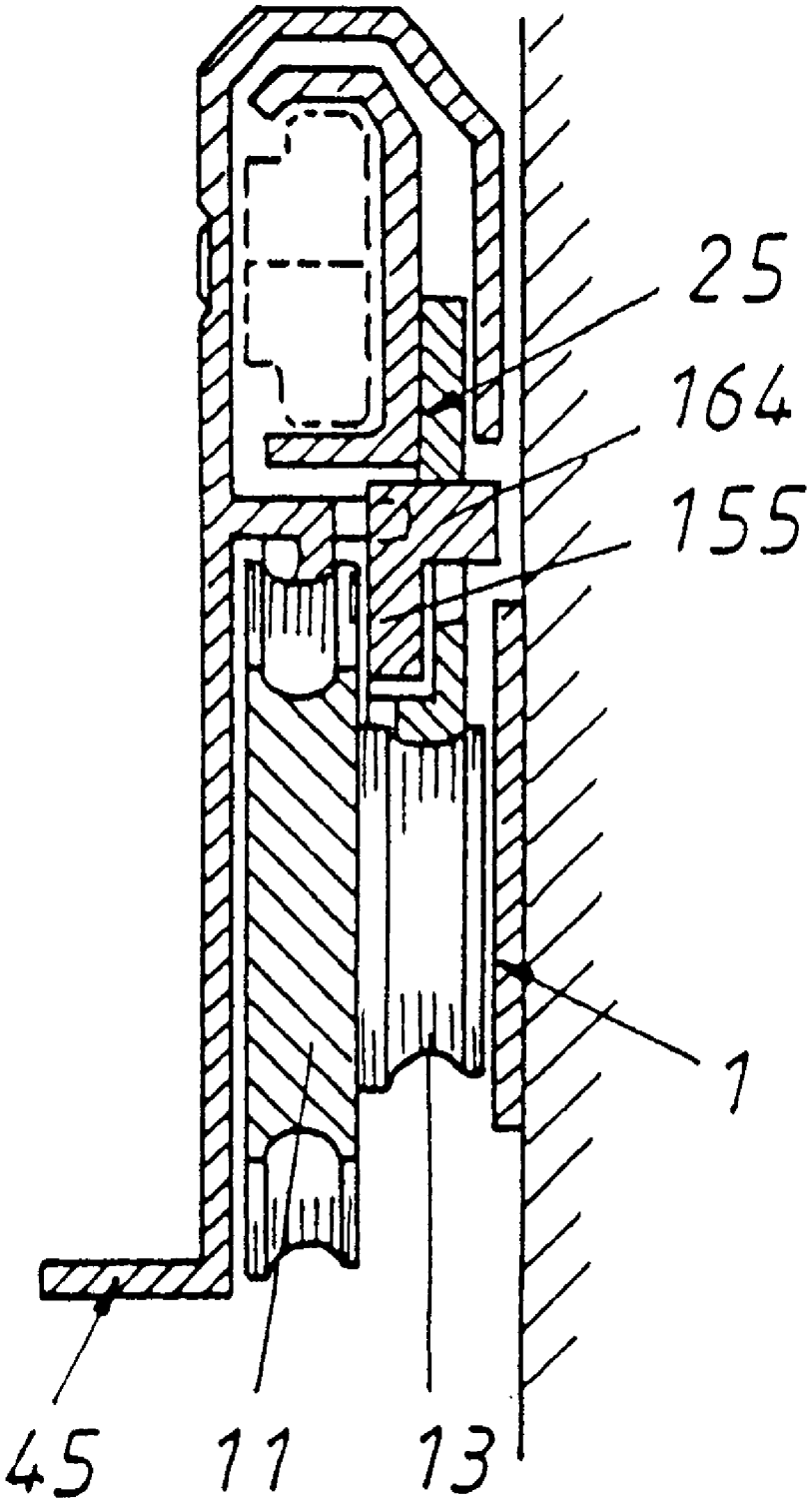
FIG. 19 shows a cross-section along line XVII—XVII in FIG. 17.

In the configuration of the invention according to FIGS. 13/14 the sliding face 65 and the flank 67 end at the same height, i.e. the lugs 61 and 63 are located at approximately the same height.

On the other hand, as soon as the drawer rail 45 is pulled out sufficiently far, the lever 55 turns clockwise under its own weight and latches into the lug 61. From this time on the intermediate rail 25 is pulled out with the drawer at the same speed as the drawer rail 45. The action of the differential roller 9 on the intermediate rail 25 lapses at this time, as the drawer rail 45 is no longer supported on the larger diameter 11.

At the end of the pulling out process the rear roller 23 of the intermediate rail 25 pushes against the rear pull-out stop 27. If the drawer is pulled out of the carcass for cleaning purposes or for other reasons, the drawer can be pulled out over the top of the pull-out stop 27 by overcoming the resistance thereof. If the roller 23 has overcome the pull-out stop 27 the drawer still cannot fall out, however, because it is still secured by the lever 55. With the trigger 71 the lever 55 can be lifted and the drawer fully released.

Attaching the drawer takes place in the reverse order. The intermediate rail 25 with the roller 23 is placed on the lower leg 17 of the intermediate rail 25. This is made possible because the upper leg 20 is not taken as far as the differential roller 9. After the roller 23 has been inserted, the intermediate rail 25 is supported with its lower edge on the small diameter 13 of the differential roller 9 and the roller 31 is supported in the groove 21. The drawer rail 45 is placed with the roller 43 on the running face 41 and then pushed in until the upper leg 47 of the drawer rail 45 is resting on the roller 31 of the intermediate rail 25. When the drawer rail 45 is pushed in, the sliding face 65 of the lever 55 on the insertion side slides upwards on the cam 69 and pivots the lever 55 in a counter clockwise direction. Then the cam 59 latches into the lever 55 and the intermediate rail 25 is thereby pushed backwards synchronously with the drawer rail 45 until the curve 60 begins to rest on the differential roller 9 and is lifted by the latter. The lifting causes the lever 55 to be released from the cam 69, and the drawer rail 45 with the drawer begins to move relative to the intermediate rail 25 and with the latter arrives in a fairly large overlap until at the end of the pushing in process all three rails 1, 25, 45 are substantially located above or inside one another.

In a further particularly advantageous configuration of the invention the lever 155 acting as coupling is again coupled to a pin 157 and is held substantially horizontal by a peg 158, which engages in a recess 160 in the intermediate rail 25, in the non-engaged position, i.e. when the drawer is pushed in. A stopper 164, which reaches through a recess 162 in the intermediate rail 25, is constructed on the lever 155 in the region of the lug 161. Said stopper is located with minimal play inside the recess 162 when the lever 155 is out of engagement with the cam 169 on the intermediate rail 25. The stopper comes into contact with the intermediate rail 25 as soon as the cam 169 presses with impact or with great force against the stopper 164. Preferably the lever 155 is connected to the intermediate rail 25 via the pin 157 with play, to enable the stopper 164 to fit closely in the orifice 162.

When the drawer is pulled out, the lever 155 slides with the leading face 165 onto the groove 13 with the smaller diameter and is lifted by it. The cam 169 herein comes into contact with the stopper 164 and is held by it. The contact of the lever 155 with the cam 169 takes place spring elastically, because a slot 172 is constructed on the lever 155 running parallel to its lower edge 170. Owing to the high elasticity of the material of which the lever 155 is made—it is preferably made of a plastics material—the narrow bridge 174 springs inwards when it is in contact with the groove 13 above the differential roller 9. So as to be able to remove the drawer completely from the guide device, the lever 155 can be pivoted by pressing the stopper 164 downwards by hand, and in fact against the elasticity of the bridge 174, until the cam 169 can be guided out above the lug 163. The flank 166 adjacent to the lug 163 is inclined to the horizontal, so that, when the drawer is pushed in, the cam 169 can move safely out of its latched position when the lever 155 is no longer being pressed upwards.

Because the lever 155 can be actuated by means of the smaller diameter on the differential roller 9, it is possible substantially to reduce the total height of the three co-operating guide rails 1, 25, 45.

The lever 155 can also be placed on guide rail devices which diverge in construction from those described in this invention.

What is claimed is:

1. Fully extendible drawer unit comprising two three-part guide devices, each with a carcass rail, for attaching to the inside of a carcass, an intermediate rail and a drawer rail, for attaching to a drawer, and rollers to which the three rails are displaceably connected relative to one another, wherein a two-step differential roller is rotatably positioned on a front end of the carcass rail, the intermediate rail carries at a rear end at the bottom and at a front end at the top in each case a rotatably positioned roller, the roller located at the top being adapted to roll along an upper guide track on the drawer rail and the roller located at the bottom being adapted to roll along in the carcass rail, and a carrying roller is rotatably attached to the drawer rail at a rear end at the top, wherein, after the rails have been fitted into one another, a smaller roller circuit of the differential roller is adjacent to a lower edge of the intermediate rail and a larger roller circuit is supported on a running face of the drawer rail and a one-armed pivotable carrier lever is coupled to the intermediate rail and has a hook-shaped end, which can be latched into the drawer rail.

2. Fully extendible drawer unit according to claim 1, wherein the drawer rail has a horizontally running leg on its lower edge, which acts as the running face for the rear roller of the intermediate rail.

3. Fully extendible drawer unit according to claim 2, wherein a groove, directed downwards, is moulded onto an upper edge of the carcass rail as an upper guide device for the rear roller of the intermediate rail, the groove extending only over part of the length of the carcass rail.

4. Fully extendible drawer unit according to claim 2, wherein an upper edge of the carcass rail in a region of the differential roller runs tangentially to an apex of the differential roller.

5. Fully extendible drawer unit according to claim 1, wherein the intermediate rail in a region of the rear roller has an off-set region and the roller is located in the plane of the intermediate rail.

6. Fully extendible drawer unit according to claim 1, wherein the carrier lever is pivotably positioned on a pin.

7. Fully extendible drawer unit according to claim 6, wherein a curve, running at an obtuse angle and able to be guided by the differential roller and lifted by it, is moulded onto a lower edge of the carrier lever.

8. Fully extendible drawer unit according to claim 6, wherein a leading face, located at an obtuse angle, and a flank are constructed on the hook-shaped end, an end of the leading face forming a lug which protrudes beyond an end of the flank.

9. Fully extendible drawer unit according to claim 6, wherein a leading face, located at an obtuse angle, and a flank are constructed on the hook-shaped end, an end of the leading face forming a lug which is located at approximately the same height as an end of the flank.

10. Coupling for a fully extendible drawer unit with two three-part guide devices, each with a carcass rail, for attaching to the inside of a carcass, an intermediate rail and a drawer rail, for attaching to a drawer, and rollers to which the three rails are displaceably connected relative to one another, with a lever, pivotably coupled to the intermediate rail and constructed so as to be able to latch into a cam on the drawer rail, the coupling comprising a lever with a slot running substantially parallel to its lower edge, which acts as leading curve, the leading curve being adapted to be lifted by a smaller diameter of a two-step differential roller.

11. Coupling for a fully extendible drawer unit according to claim 10, wherein the slot is adapted to form a leading curve spring elastically.

12. Coupling for a fully extendible drawer unit according to claim 10, wherein a hook-shaped lug is constructed on the lever on a side opposed to the leading curve.

13. Coupling for a fully extendible drawer unit according to claim 10, wherein a stopper adapted to engage in at least one of the intermediate rail and a peg are constructed on the lever.

* * * * *